US005882448A

United States Patent [19]

Seki et al.

[11] Patent Number: 5,882,448

[45] Date of Patent: Mar. 16, 1999

[54] CONTACT MATERIAL FOR VACUUM VALVE AND METHOD OF MANUFACTURING THE SAME

[75] Inventors: Tsuneyo Seki, Tokyo; Tsutomu Okutomi, Kanagawa-ken; Atsushi Yamamoto; Takashi Kusano, both of Tokyo, all of Japan

[73] Assignee: Kabushiki Kaisha Toshiba, Kawasaki, Japan

[21] Appl. No.: 909,875

[22] Filed: Aug. 12, 1997

Related U.S. Application Data

[62] Division of Ser. No. 391,224, Feb. 21, 1995, Pat. No. 5,698,008.

[30] Foreign Application Priority Data

Feb. 21, 1994 [JP] Japan ..... 6-021682
Dec. 16, 1994 [JP] Japan ..... 6-312982

[51] Int. Cl.[6] ..... C22F 1/08

[52] U.S. Cl. ..... 148/679; 148/432; 419/25

[58] Field of Search ..... 419/25; 148/432, 148/679; 420/470

[56] References Cited

U.S. PATENT DOCUMENTS

| | | | |
|---|---|---|---|
| 3,143,442 | 8/1964 | Watts et al. . | |
| 4,517,033 | 5/1985 | Okumura et al. | 148/432 |
| 4,777,335 | 10/1988 | Okutomi et al. | 200/264 |
| 4,830,821 | 5/1989 | Okutomi et al. | 419/25 |
| 5,045,281 | 9/1991 | Okutomi et al. | 420/497 |
| 5,205,878 | 4/1993 | Kanzaki et al. | 148/684 |
| 5,306,465 | 4/1994 | Caron et al. | 420/492 |
| 5,500,499 | 3/1996 | Seki et al. | 218/130 |

FOREIGN PATENT DOCUMENTS

| | | |
|---|---|---|
| 0 115 292 A2 | 8/1984 | European Pat. Off. . |
| 59-81816 | 5/1984 | Japan . |
| 59-91617 | 5/1984 | Japan . |
| 4-71970 | 11/1992 | Japan . |

OTHER PUBLICATIONS

Patent Abstracts of Japan, vol. 014, No. 012 (E–871), Jan. 11, 1989.

*Primary Examiner*—Ngoclan Mai
*Attorney, Agent, or Firm*—Oblon, Spivak, McClelland, Maier & Neustadt, P.C.

[57] ABSTRACT

A contact material for a vacuum valve including, a conductive constituent including at least copper, an arc-proof constituent including at least chromium and an auxiliary constituent including at least one selected from the group consisting of tungsten, molybdenum, tantalum and niobium. The contact material is manufactured by quench solidification of a composite body of the conductive constituent, the arc-proof constituent and the anxiliary constituent.

20 Claims, 1 Drawing Sheet

CONTACT MATERIAL FOR VACUUM VALVE AND METHOD OF MANUFACTURING THE SAME

This is a Division, of application Ser. No. 08/391,224 filed on FEB. 21, 1995 now U.S. Pat. No. 5,698,008.

BACKGROUND OF THE INVENTION

1. Field of the Invention

This invention relates to a contact material for a vacuum valve and a method of manufacturing the same.

2. Description of the Related Art

The most important properties which a contact material for vacuum valve is required to have are the three basic requirements of anti-welding property, voltage withstanding capability and current interrupting property. Further important requirements are to show low and stable rise in temperature and low and stable contact resistance. However, it is not possible to satisfy all these requirements by a single metal, as some of them are contradictory. Consequently, many of the contact materials that have been developed for practical use consist of combinations of two or more elements so as to complement their mutual deficiencies in performance, and to match specific applications such as large-current use or high voltage-withstanding use. Contact materials have been developed possessing excellent properties in their own way. However, performance requirements have become increasingly severe and the present situation is that these materials are unsatisfactory in some respects.

There has been a marked tendency in recent years to expand the range of circuits to which these materials are applied to reactor circuits and capacitor circuits etc., and development and improvement of the contact materials corresponding to these application has become an urgent task. In particular, regarding capacitor circuits, due to the application of twice the voltage of an ordinary circuit, problems have arisen in respect of the withstand voltage characteristic of the contacts, in particular of suppressing occurrence of restriking. In order to cope with this, conventionally, Cu—Cr contact material has been employed, which has excellent current interrupting property and comparatively good withstand voltage characteristics.

However, such Cu—Cr contact material can cope to some extent in the high withstand voltage field. But in more severe high withstand voltage regions and in circuits that are subject to inrush current, there is a problem of occurrence of restriking. One of the reasons why Cu—Cr contact material does not necessarily exhibit sufficient performance in the high withstand voltage region is considered to be as follows. Opening and closing of the contacts results in the formation of Cu—Cr finely dispersed layer at the contact surface, which is of mechanically higher strength than the contact material. It is believed that micro-welding locally produced by the inrush current causes the exfoliation from the contact material portion, with the formation of severe surface irregularity, causing field concentration and clump. Consequently, it is believed that the probability of occurrence of restriking should be able to be reduced by increasing the strength of the contact material.

Infiltrated Cu—Cr contact obtained by infiltrating Cu into a Cr skeleton manufactured by sintering Cr powder show a lower rate of occurrence of restriking than solid-phase sintered Cu—Cr contacts manufactured by mixing and sintering Cr powder and Cu powder. Furthermore, Cu—Cr contacts made by arc melting of a consumable electrode manufactured of Cu—Cr show even lower rate of occurrence of restriking.

However, in the Cu—Cr contacts manufactured by the consumable arc melting method, local non-uniformity in the contact micro structure is formed by the occurrence of two-phase separation of a Cu-rich liquid phase and Cr-rich liquid phase that are produced during solidification and cooling steps of the consumable arc melting method. Since this Cr-rich portion is brittle in terms of material, cracking and breaking away occur during opening and closing of the contacts, causing restriking to occur.

Hereinafter another problem of the conventional contact material will be described. The present situation is that contact materials for a vacuum valve which are able to fully satisfy increasingly severe requirements in respect of high withstand voltage property and large current interrupting capability have not yet been developed.

In recent years therefore some use has been made of contact materials combining arc-proof constituents of excellent withstand voltage performance and arc-proof constituents having excellent current interrupting performance. For example, Japanese Patent Disclosures (kokai) No. Sho. 59-81816 and No. Sho. 59-91617 disclose contact materials having prescribed contents of Ta and Nb in a Cu—Cr contact material, which have excellent current interruption performance and also improved voltage withstanding characteristics.

However, regarding contact materials for a vacuum valve as described above, with contact materials manufactured by a solid-phase sintering process, in which the conductive constituent and other arc-proof constituents are simply mixed and sintered, it can hardly be said that fully satisfactory contact materials (i.e. contact materials wherein both these characteristics are improved and stabilized) have been obtained.

Means for improving the withstand voltage characteristic and current interruption performance, in particular, a method of manufacture whereby the withstand voltage characteristic is improved are disclosed in, for example, Japanese Patent Disclosure (Kokai) No. Sho. 63-158022. However, it cannot necessarily be said that this can satisfy the requirements.

SUMMARY OF THE INVENTION

Accordingly, one object of this invention is to provide a contact material for a vacuum valve wherein the frequency of the occurrence of restriking can be reduced.

Another object of this invention is to provide a method for manufacturing a contact material for a vacuum valve wherein the frequency of the occurrence of restriking can be reduced.

Still another object of this invention is to provide a contact material for a vacuum valve which has a stable high withstand voltage characteristic and an excellent current interruption performance.

A further object of this invention is to provide a method for manufacturing a contact material for a vacuum valve which has a stable high withstand voltage characteristic and an excellent current interruption performance.

These and other objects of this invention can be achieved by providing a contact material for a vacuum valve including, a conductive constituent including at least copper, an arc-proof constituent including at least chromium and an auxiliary constituent including at least one selected from the group consisting of tungsten, molybdenum, tantalum and niobium. The contact material is manufactured by quench solidification of a composite body of the conductive constituent, the arc-proof constituent and the anxiliary constituent.

According to one aspect of this invention, there is provided a method for manufacturing a contact material for a vacuum valve including the steps of, preparing a composite body of a conductive constituent including at least copper, an arc-proof constituent including at least chromium and an auxiliary constituent including at least one selected from the group consisting of tungsten, molybdenum, tantalum and niobium, and quench solidificating the composite body to obtain the contact material.

According to another aspect of this invention, there is provided a contact material for a vacuum valve including, a conductive constituent and at least two arc-proof constituents. The arc-proof constituents are contained in a dispersed state in the contact material.

According to still another aspect of this invention, there is provided a method for manufacturing a contact material for a vacuum valve including the steps of, mixing at least two of arc-proof constituents to obtain a composite body, sintering the composite body to form a sintered body, and diffusing the arc-proof constituents of the sintered body in a solution of a conductive constituent, thereby to obtain the contact material.

The reason for the production of a Cr-rich phase by the quench solidification method, such as a consumable arc melting method, is that two-phase separation of the Cu-rich liquid phase and Cr-rich liquid phase occur until the molten liquid phase has solidified, and the Cr-rich liquid phase which is of smaller specific gravity floats upwards. The inventors therefore considered that it might be possible to suppress the occurrence of Cr-rich phase by shortening the time available for solidification of the liquid phase and by decreasing the specific gravity difference between the two phases. Shortening the solidification time should be possible by increasing the quantity of solidification nuclei. Also, regarding decreasing the specific gravity difference, this should be possible by adding some constituent of larger specific gravity than Cr and which is soluble in Cr.

By taking notice of the above items, it was found that the production of a Cr-rich portion could be excluded by carrying out quench solidification with further addition of at least one of W, Mo, Ta and Nb to Cu and Cr.

The present inventors have investigated in terms of metallographic or electrical phenomena the reasons why contact material containing arc-proof constituents of excellent withstand voltage characteristic and arc-proof constituents of excellent current interruption performance, did not exhibit better performance than anticipated. They have discovered that the major reasons of this have to do with matalic structure of the contact material. Specifically, with regard to current interruption performance, the characteristic of current interruption performance is not determined solely by the arc-proof constituent itself. The better current interruption performance is shown by materials wherein the grain size of the arc-proof constituent is fine or wherein the arc-proof constituent is uniformly distributed in a contact material. Furthermore, with respect to withstand voltage characteristic too, the most stable characteristic tends to be obtained when the contact micro structure is uniform.

Having ascertained that it is important for a plurality of arc-proof constituents to be uniformly dispersed, consideration is given to employing diffusion as a method to achieve this. However, it is difficult to diffuse a plurality of arc-proof constituents at ordinary sintering temperature of for example 1450 K. Even if diffusion can be achieved, it is only over a very restricted region. As a method of promoting diffusion, sintering at higher temperatures may be considered, but this is not practicable from the manufacturing aspect.

At this, the inventors have discovered diffusion of the arc-proof constituents through a liquid phase. It is difficult to make the arc-proof constituent a liquid phase, but it is relatively easy to make the conductive constituent, which is a main structural constituent of the contact material, a liquid phase. The arc-proof constituents can be soluble to a greater or lesser extent in such conductive constituent, thereby enabling diffusion of the arc-proof constituents. Fineness of the arc-proof constituents can be increased by this diffusion effect.

As a result, with the contact materials according to this invention, improvement in characteristic in regard to current interruption performance and withstand voltage characteristic over the conventional contact materials as described above can be achieved.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
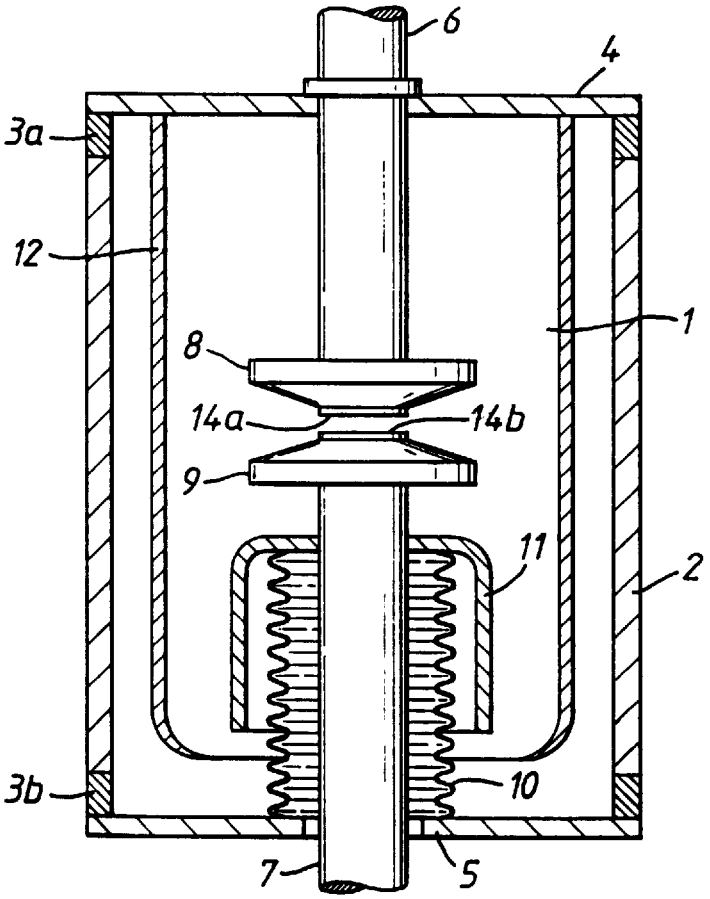
FIG. 1 is a cross-sectional view of a vacuum valve to which a contact material for a vacuum valve of this invention is applied.

Referring now to the drawings, wherein like reference numerals designate identical or corresponding parts throughout the several views, the embodiments of this invention will be described below.

Figure 2:
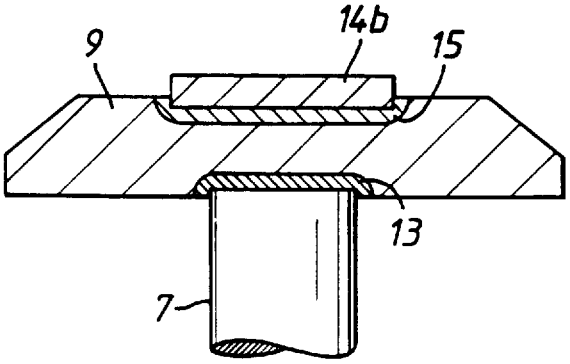
FIG. 2 is a view to a larger scale of major parts of FIG. 1.

FIG. 1 is a cross-sectional view of a vacuum valve to which a contact material for a vacuum valve of this invention has been applied, and FIG. 2 is a view to a larger scale of major parts of FIG. 1.

In these Figures, a breaking chamber 1 is sealed in vacuum-tight manner by an insulating enclosure 2 formed in practically cylindrical shape by means of an insulating material such as ceramic and metal caps 4 and 5 provided at both ends thereof through sealing means 3*a*, 3*b*.

In addition, a fixed electrode 8 and a movable electrode 9 are respectively arranged at the ends of a pair of mutually facing electrode rods 6 and 7 within breaking chamber 1.

Also, a bellows 10 is fitted on electrode rod 7 of movable electrode 9 so that the pair of electrodes 8 and 9 can be opened and closed by reciprocatory movement of electrode 9 whilst maintaining vacuum tightness within breaking chamber 1.

Furthermore, this bellows 10 is covered by a hood 11 so as to prevent deposition of arc vapor. Also, within breaking chamber 1, there is further provided a cylindrical metal enclosure 12, so as to prevent deposition of arc vapor on to insulating enclosure 2.

Movable electrode 9 is fixed by brazing 13 to electrode rod 7 as shown in FIG. 2, or is press fitted (not shown) by caulking, and a movable contact 14*b* is joined thereon by brazing 15.

The arrangement of fixed electrode 8 is practically the same except that it faces in the opposite direction. A fixed contact 14*a* is provided thereon.

An example of a method of manufacturing a contact material according to an embodiment of this invention will now be described. A method of manufacture by the consumable arc melting method will be described as an example of a quench solidification method. The consumable electrode with the contact target composition is manufactured by a powder metallurgy method or a sheet material lamination method etc. This electrode is used as the consumable electrode (anode side) for arc melting, and the interior of the arc furnace enclosure is evacuated to, for example, $10^{-3}$ (Pa). Then, to suppress the vaporisation of the molten metal by introducing, for example, high-purity Ar, a degree of vacuum of about $2\times10^4$ (Pa), is obtained. An ingot of the prescribed composition is obtained in a water-cooled Cu crucible opposite to the consumable electrode, by means of a prescribed arc voltage, a prescribed arc current and a prescribed rate of consumption. The detail of the consumable arc melting method is disclosed in, for example, Japanese Patent Publication (Kokoku) No. Heisei 4-71970, published on Nov. 17, 1992. So the detailed description thereof can be omitted.

Next, a method of evaluation and the evaluation results will be explained with reference to concrete examples to be described later. With the above described matters in view, a comparison was made between the contact material according to this invention and conventionally manufactured contact material, in terms of frequency of occurrence of restriking. The disc-shaped sample of contact material of diameter 30 mm, thickness 5 mm is fitted in a demountable-type vacuum valve. And then, measurements were carried out by measuring the frequency of occurrence of restriking on breaking a 60 kV×500A circuit 2000 times by the demountable-type vacuum valve. Two circuit breakers (i.e. six vacuum valves) were used in the measurements. The results were expressed as a percentage occurrence of restriking. For fitting the contacts, only baking heating (450° C.×30 minutes) was performed. Brazing material was not used, and the heating which would accompany this was not performed.

Next, the evaluation results will be considered referring to Table A1.

[TABLE A1]

| | Chemical constituents (volume %) | | | Method of Manufacturing the | Percentage occurrence of Restriking (%) | Notes |
|---|---|---|---|---|---|---|
| | Cr | Nb | Cu | contacts | | |
| Comparative example A1 | 50 | 0 | Bal (50) | Arc melting | 1.5 | |
| Comparative example A2 | 50 | 0.1 | Bal (50) | Arc melting | 1.5 | |
| Example A1 | 50 | 1 | Bal (49) | Arc melting | 0.7 | |
| Example A2 | 50 | 10 | Bal (40) | Arc melting | 0.6 | |
| Comparative example A3 | 50 | 30 | Bal (20) | Arc melting | 0.8 | Large contact resistance |
| Comparative example A4 | 10 | 10 | Bal (80) | Arc melting | 0.7 | Current Interruption impossible |
| Example A3 | 20 | 10 | Bal (70) | Arc melting | 0.6 | |
| Example A2 | 50 | 10 | Bal (40) | Arc melting | 0.6 | |
| Comparative example A5 | 70 | 10 | Bal (20) | Arc melting | 0.8 | Large contact resistance |

[TABLE A1]-continued

| | Chemical constituents (volume %) | | | Method of Manufacturing the | Percentage occurrence of Restriking (%) | Notes |
|---|---|---|---|---|---|---|
| | Cr | Nb | Cu | contacts | | |
| Example A4 | 20Cr-5Ta-Cu | | | Arc melting | 0.7 | |
| Example A5 | 30Cr-10Mo-Cu | | | Electroslag melting | 0.6 | |
| Example A6 | 20Cr-40W-Cu | | | Electroslag melting | 0.7 | |

EXAMPLES A1–A2, COMPARATIVE EXAMPLES A1–A3

Consumable electrodes were manufactured as laminated plates, with auxiliary constituent Nb volume percentages of 0, 0.1, 1, 10 and 30, the content of arc-proof material Cr being kept fixed at 50 volume %, and the remainder being Cu, respectively. These were respectively comparative examples A1, A2, examples A1, A2 and comparative example A3. Manufacture of ingots were carried out by a consumable arc melting method with the condition of an arc voltage of about 35 V, an arc current of 1.5 KA, and under a vacuum atmosphere of $2\times10^4$ (Pa) of Ar, using the consumable electrodes described above, respectively. These were processed to the contact shape described above, and then were fitted into the demountable-type vacuum valve, and restriking occurrence rates were evaluated, respectively. As shown in the Table A1, in the case of comparative example A1 in which there was no addition of Nb, and in the case of comparative example A2 in which only a trace of Nb was added, the restriking occurrence rates were 1.5% in both cases. In the cases of examples A1 and A2, in which 1% and 10% of Nb were added respectively, restriking occurrence rates of 0.6–0.7% were obtained i.e. good performance was obtained. However, in the case of comparative example A3 in which 30% of Nb was added, while the restriking occurrence rate was good at 0.8%, the contact resistance was large, thus making the contact unusable.

EXAMPLES A2–A3, COMPARATIVE EXAMPLES A4–A5

The consumable arc melting method was used to manufacture contacts wherein the content of the auxiliary constituent Nb was fixed at 10 volume %, while the contents of Cr which is the main arc-proof constituent were respectively 10, 20, 50 and 70 volume %, respectively. The arc current and voltage were the same as in example A1 described above. Comparative example A4 in which the Cr addition was 10% showed a good restriking occurrence rate of 0.7%, but its current interrupting performance was unsatisfactory. Examples A3 and A2, in which the Cr addition were 20 and 50% respectively showed restriking occurrence rates of 0.6 and 0.6%. Comparative example A5 in which the Cr addition was 70% showed an improved restriking occurrence rate, but had the drawback of a large contact resistance.

EXAMPLE A4–A6

The above examples, A1–A3 relates to contact materials of the Cr—Nb—Cu system, but other contact materials consisting of other system will be considered. As shown by examples A4–A6, good performance in respect of lowering of the restriking occurrence rate can be obtained by addition of Mo, Ta or W in place of Nb.

The quench solidification method to be used in this invention is not limited to the consumable arc melting method. When, manufacture of the contact material is performed using the electroslag method as shown in examples A5–A6 instead of the consumable arc melting method, good performance is obtained, as in the case of the consumable arc melting method. The detail of the electroslag method is disclosed, for example, Japanese Patent Publication (kokoku) No. Showa 46-36427, published on Oct. 26, 1971, so the detailed description thereof can be omitted. It is therefore clear that the same benefits are obtained even by manufacture of the contact materials by other method of manufacture satisfying quench solidification.

As described above, with an embodiment of this invention, the frequency of restriking occurrence can be reduced by the quench solidification of a composition consisting of a conductive constituent whose main constituent is Cu, an arc-proof constituent whose main constituent is Cr, and an auxiliary constituent containing at least one of W, Mo, Ta and Nb.

Hereinafter another embodiment of this invention will be described. The contact material according to another embodiment of this invention is suitable for constructing both or either of contacts 14*a*, 14*b* shown in FIG. 1.

Firstly, the method of evaluating the contacts will be described.

(1) Withstand voltage characteristic

For each contact alloy, the static withstand voltage was found by measuring the voltage when a spark was generated between two electrodes described below on gradually raising the voltage in a vacuum atmosphere of the order of $10^{-4}$ Pa, using a needle electrode and a flat-plate electrode finished to a specular surface by buffing, the separation between the two electrodes being fixed at 0.5 mm. The measurement data of withstand voltages shown in Table B1 and Table B2 are values obtained by repeating the test fifty times. They are shown as relative values including the variations, taking the mean values of the withstand voltages of the comparative examples described later as being 1.0, respectively.

(2) Current interruption

For each contact alloy, current interruption tests were performed by mounting a pair of contacts made of diameter 45 mm into a vacuum valve as described above, then gradually increasing the interruption current. The measurement data of interruption currents shown in Table B1 and Table B2 are shown as relative values taking the interruption currents of the comparative examples described later as being 1.0, respectively.

[TABLE B1]

| | Composition of contacts (volume %) | Withstand voltage characteristic (relative value with respect to comparative example) | Current interruption performance (relative value with respect to comparative example) | Notes (method of manufacture) |
|---|---|---|---|---|
| Comparative example B1 | 30Cr-20W-Cu | 0.8–1.2 | 1.0 | Solid-phase sintering method |
| Example B1 | 30Cr-20W-Cu | 1.1–1.3 | 1.2 | Diffusion in Cu solution |

[TABLE B1]-continued

| | Composition of contacts (volume %) | Withstand voltage characteristic (relative value with respect to comparative example) | Current interruption performance (relative value with respect to comparative example) | Notes (method of manufacture) |
|---|---|---|---|---|
| Comparative example B2 | 30Cr-20Fe-Cu | 0.8–1.2 | 1.0 | Solid-phase sintering method |
| Example B2 | 30Cr-20Fe-Cu | 1.1–1.3 | 1.2 | Diffusion in Cu solution |
| Comparative example B3 | 20Mo-20Nb-Cu | 0.8–1.2 | 1.0 | Solid-phase sintering method |
| Example B3 | 20Mo-20Nb-Cu | 1.1–1.3 | 1.2 | Diffusion in Cu solution |
| Comparative example B4 | 20Mo-20Nb-10Hf-Cu | 0.8–1.2 | 1.0 | Solid-phase sintering method |
| Example B4 | 20Mo-20Nb-10Hf-Cu | 1.1–1.2 | 1.1 | Diffusion in Cu solution |
| Comparative example B5 | 30Ta-20V-Cu | 0.8–1.2 | 1.0 | Solid-phase sintering method |
| Example B5 | 30Ta-20V-Cu | 1.1–1.2 | 1.3 | Diffusion in Cu solution |
| Comparative example B6 | 30Nb-20Zr-Ag | 0.8–1.2 | 1.0 | Solid-phase sintering method |
| Example B6 | 30Nb-20Zr-Ag | 1.0–1.2 | 1.1 | Diffusion in Ag liquid phase |
| Comparative example B7 | 30Mo-20Ti-Ag | 0.8–1.2 | 1.0 | Solid-phase sintering method |
| Example B7 | 30Mo-20Ti-Ag | 1.0–1.2 | 1.1 | Diffusion in Ag liquid phase |
| Comparative example B8 | 20Mo-20W-10Y-Ag | 0.8–1.3 | 1.0 | Solid-phase sintering method |
| Example B8 | 20Mo-20W-10Y-Ag | 1.0–1.2 | 1.1 | Diffusion in Ag liquid phase |
| Comparative example B9 | 20Co-20Ni-10Ti-Ag | 0.8–1.2 | 1.0 | Solid-phase sintering method |
| Example B9 | 20Co-20Ni-10Ti-Ag | 1.0–1.2 | 1.1 | Diffusion in Ag liquid phase |
| Comparative example B10 | 30Cr-20V-10Ag-Cu | 0.8–1.2 | 1.0 | Solid-phase sintering method |
| Example B10 | 30Cr-20V-10Ag-Cu | 1.0–1.2 | 1.1 | Diffusion in Ag-Cu liquid phase |
| Compara- | 30Cr-20W- | 0.8–1.2 | 1.0 | Solid- |

[TABLE B1]-continued

| | Composition of contacts (volume %) | Withstand voltage characteristic (relative value with respect to comparative example) | Current interruption performance (relative value with respect to comparative example) | Notes (method of manufacture) |
|---|---|---|---|---|
| tive example B11 | 0.5Bi-Cu | | | phase sintering method |
| Example B11 | 30Cr-20W-0.5Bi-Cu | 1.0–1.2 | 1.2 | Diffusion in Cu-Bi solution |
| Comparative example B12 | 30Cr-20W-0.5Bi-0.3Te-0.2Sb-Cu | 0.8–1.2 | 1.0 | Solid-phase sintering method |
| Example B12 | 30Cr-20W-0.5Bi-0.3Te-0.2Sb-Cu | 1.0–1.2 | 1.2 | Diffusion in Cu-Bi-Te-Sb solution |

[TABLE B2]

| | Composition of contacts (volume %) | Withstand voltage characteristic (relative value with respect to comparative example) | Current interruption performance (relative value with respect to comparative example) | Notes (method of manufacture) |
|---|---|---|---|---|
| Comparative example B13 | 10Cr-5W-Cu | 0.9–1.1 | 1.0 | Diffusion in Cu liquid phase |
| Example B13 | 15Cr-10W-Cu | 1.0–1.2 | 1.3 | Diffusion in Cu liquid phase |
| Example B14 | 30Cr-10W-Cu | 1.0–1.2 | 1.2 | Diffusion in Cu liquid phase |
| Example B15 | 40Cr-20W-Cu | 1.0–1.2 | 1.2 | Diffusion in Cu liquid phase |
| Example B16 | 55Cr-30W-Cu | 1.0–1.2 | 1.2 | Diffusion in Cu liquid phase |
| Comparative example B14 | 65Cr-25W-Cu | 1.0–1.3 | — | Diffusion in Cu liquid phase |

Next, the measurement results obtained by the method of evaluation described above will be considered in detail with reference to Tables B1 and B2.

COMPARATIVE EXAMPLE B1, EXAMPLE B1

Powder consisting of a mixture of Cr powder of mean grain size 100 μm, W powder of mean grain size 7 μm, and Cu powder of mean grain size 45 μm was molded at a molding pressure of 8 Ton/cm$^2$. It was then sintered under the conditions 1273 K×1 Hr. in a vacuum atmosphere of the order of $10^{-3}$ Pa. Next, it was molded at a molding pressure of 8 Ton/cm$^2$, and then sintered in the same condition as described above. Contacts having composition of 30Cr—20W—Cu as shown in Table B1 were thereby obtained. When the interior of the contact was observed using an electron microscope fitted with an EPMA (Electron Probe Micro Analyzer), diffused phases of Cr and W could not be detected definitely. When the static withstand voltage of these contacts was measured by the test method described above, the relative values were 0.8–1.2 i.e. the measured values showed considerable variations (comparative example B1).

Powder produced by mixing Cr powder of mean grain size 100 μm and W powder of mean grain size 7 μm was molded under a molding pressure of 2 Ton/cm$^2$. It was then sintered in a vacuum atmosphere of the order of $10^{-3}$ Pa under the conditions 1273 K×1 Hr. Cu was then infiltrated under the conditions 1400 K×0.5 Hr. in a vacuum atmosphere of the order of $10^{-3}$ Pa and diffusion of Cr and W was performed in the copper. Contacts having compositions: 30Cr—20W—Cu were thereby obtained. When the interior of the contacts was observed using an electron microscope equipped with EPMA, it was found that mutual diffusion of Cr and W had taken place, and fine arc-proof grains consisting of Cr and W were observed. When the static withstand voltage of these contacts was measured by the test method described above, the relative values with respect to comparative example B1 were found to be 1.1–1.3, with only a small range of variations, and the withstand voltage characteristic was improved on the whole. Furthermore, the current interrupting characteristic showed a value of 1.2 times that of the comparative example B1 (example B1).

COMPARATIVE EXAMPLE B2, EXAMPLE B2

Contacts of composition: 30Cr—20Fe—Cu were obtained by molding a powder obtained by mixing Cr powder of mean grain size 100 μm, Fe powder of mean grain size 50 μm and Cu powder of mean grain size 45 μm, at a molding pressure of 8 Ton/cm$^2$, followed by sintering in a vacuum atmosphere of the order of $10^{-3}$ Pa under the conditions 1273 K×1 Hr., then further sintering under the same conditions after molding at a molding pressure of 8 Ton/cm$^2$. When the static withstand voltage of these contacts was measured by the test method described above, the relative values of 0.8–1.2 were obtained i.e. there was a large range of variations (comparative example B2).

Contacts having a composition: 30Cr—20Fe—Cu were obtained by molding under a molding pressure of 2 Ton/cm$^2$ a powder obtained by mixing Cr powder of mean grain size 100 μm with Fe powder of mean grain size 50 μm, followed by sintering in vacuum atmosphere of the order of $10^{-3}$ Pa under the conditions 1273×1 Hr., then infiltrating Cu under vacuum atmosphere of the order of $10^{-3}$ Pa under the conditions 1400 K×0.5 Hr., and diffusion of Cr and Fe in Cu. When the static withstand voltage of these contacts was measured by the test method described above, a relative value of 1.1–1.3 with respect to comparative example B2, was obtained, with little range of variations, and an overall improvement in withstand voltage characteristic. The current interrupting characteristic also showed a value of 1.2 times that of comparative example B2, (example B2).

COMPARATIVE EXAMPLE B3, EXAMPLE B3

Contacts having composition: 20Mo—30Nb—Cu were obtained by molding, under a molding pressure of 8 Ton/cm$^2$, powder obtained by mixing Mo powder of mean grain size 10 μm, Nb powder of mean grain size 50 μm and Cu powder of mean grain size 25 μm, followed by sintering under vacuum atmosphere of the order of $10^{-3}$ Pa and the conditions: 1273 K×1 Hr., then again molding at a molding pressure of 8 Ton/cm$^2$, followed by sintering under the same conditions. When the static withstand voltage of these contacts was measured by the test method described above, a relative value of 0.8–1.2 was obtained. There was a large range of variations (comparative example B3).

Contacts having composition 20Mo—30Nb—Cu were obtained by molding under a molding pressure of 2 Ton/Cm$^2$ powder obtained by mixing Mo powder of mean grain size 10 $\mu$m with Nb powder of mean grain size 50 $\mu$m, followed by sintering under vacuum atmosphere of the order of $10^{-3}$ Pa under the conditions 1273 K×1 Hr., followed by infiltration of Cu under the conditions 1400 K×0.5 Hr. under vacuum atmosphere of the order of $10^{-3}$ Pa, and performing diffusion of Mo and Nb in the copper. When the static withstand voltage of these contacts was measured by the test method described above, relative values of 1.1–1.3 with respect to comparative example B3 were obtained, the range of variations was also small, and the withstand voltage characteristic was improved on the whole. Also, the current interrupting characteristic showed a value 1.2 times that of comparative example B3 (example B3).

COMPARATIVE EXAMPLE B4, EXAMPLE B4

Contacts of composition: 20Mo—20Nb—10Hf—Cu were obtained by molding with a molding pressure of 8 Ton/cm$^2$ powder obtained by mixing Mo powder of mean grain size 10 $\mu$m, Nb powder of mean grain size 50 $\mu$m, Hf powder of mean grain size 100 $\mu$m and Cu powder of mean grain size 45 $\mu$m, followed by sintering under vacuum atmosphere of the order of $10^{-3}$ Pa under the conditions 1273 K×1 Hr., followed by further molding at a molding pressure of 8 Ton/cm$^2$, then sintering under the same conditions. On measurement of the static withstand voltage of these contacts by the test method described above, a relative value of 0.8–1.2 was obtained, with a considerable range of variations (comparative example B4).

Contacts of composition: 20Mo—20Nb—10Hf—Cu were obtained by molding powder obtained by mixing Mo powder of mean grain size 10 $\mu$m, Nb powder of mean grain size 50 $\mu$m and Hf powder of mean grain size 100 $\mu$m under a molding pressure of 2 Ton/cm$^2$, followed by sintering in a vacuum atmosphere of the order of $10^{-3}$ Pa under the conditions 1273 K×1 Hr., then infiltrating Cu under vacuum atmosphere of the order of $10^{-3}$ Pa under the conditions 1400 K×0.5 Hr., and diffusion of Mo, Nb and Hf in Cu. When the static withstand voltage of these contacts was measured by the test method described above, a value of 1.1–1.2 in terms of relative values with respect to comparative example B4 was obtained, with little range of variations and improvement in the withstand voltage characteristic on the whole. The current interrupting characteristic also showed a value of 1.1 times that of comparative example B4 (example B4).

COMPARATIVE EXAMPLE B5, EXAMPLE B5

Contacts of composition: 30Ta—20V—Cu were obtained by molding with a molding pressure of 8 Ton/cm$^2$ powder obtained by mixing Ta powder of mean grain size 50 $\mu$m, V powder of mean grain size 100 $\mu$m and Cu powder of mean grain size 45 $\mu$m , followed by sintering under vacuum atmosphere of the order of $10^{-3}$ Pa under the conditions 1273 K×1 Hr., followed by further molding under a molding pressure of 8 Ton/cm$^2$, then sintering under the same conditions. On measurement of the static withstand voltage of these contacts by the test method described above, a relative value of 0.8–1.2 was obtained, with a considerable range of variations (comparative example B5).

Contacts of composition: 30Ta—20V—Cu were obtained by molding powder obtained by mixing Ta powder of mean grain size 50 $\mu$m with V powder of mean grain size 100 $\mu$m under a molding pressure of 2 Ton/cm$^2$, followed by sintering in a vacuum atmosphere of the order of $10^{-3}$ Pa under the conditions 1400 K×0.5 Hr., then infiltrating Cu under vacuum atmosphere of order $10^{-3}$ Pa under the conditions 1400 K×0.5 Hr., and diffusion of Ta and V in Cu. When the static withstand voltage of these contacts was measured by the test method described above, a value of 1.1–1.2 in terms of relative values with respect to comparative example B5 was obtained, with a little range of variations and improvement in the withstand voltage characteristic on the whole. The current interrupting characteristic also showed a value of 1.3 times that of comparative example B5 (example B5).

COMPARATIVE EXAMPLE B6, EXAMPLE B6

Contacts of composition: 30Nb—20Zr—Ag were obtained by molding with a molding presure of 8 Ton/cm$^2$ powder obtained by mixing Nb powder of mean grain size 50 $\mu$m, Zr powder of mean grain size 50 $\mu$m and Ag powder of mean grain size 30 $\mu$m, followed by sintering under vacuum atmosphere of the order of $10^{-3}$ Pa under the conditions 1173 K×1 Hr., followed by further molding under 8 Ton/cm$^2$, then sintering under the same conditions. On measurement of the static withstand voltage of these contacts by the test method described above, a relative value of 0.8–1.2 was obtained, with a considerable range of variations (comparative example B6).

Contacts of composition: 30Nb—20Zr—Ag were obtained by molding powder obtained by mixing Nb powder of mean grain size 50 $\mu$m with Zr powder of mean grain isize 50 $\mu$m under a molding pressure of 2 Ton/cm$^2$, followed by sintering in a vacuum atmosphere of the order of $10^{-3}$ Pa under the conditions 1173 K×1 Hr., then infiltrating Ag under vacuum atmosphere of the order of $10^{-3}$ Pa under the conditions 1300 K×0.5 Hr., and diffusion of Nb and Zr in Ag. When the static withstand voltage of these contacts was measured by the test method described above, a value of 1.0–1.2 in terms of relative values with respect to comparative example B6 was obtained, with little range of variations and improvement in the withstand voltage characteristic on the whole. The current interrupting characteristic also showed a value of 1.1 times that of comparative example B6 (example B6).

COMPARATIVE EXAMPLE B7, EXAMPLE B7

Contacts of composition: 30Mo—20Ti—Ag were obtained by molding with a molding pressure of 8 Ton/cm$^2$ powder obtained by mixing Mo powder of mean grain size 10 $\mu$m, Ti powder of mean grain size 50 $\mu$m and Ag powder of mean grain size 30 $\mu$m, followed by sintering under vacuum atmosphere of the order of $10^{-3}$ Pa under the conditions 1173 K×1 Hr., followed by further molding under a molding pressure of 8 Ton/cm$^2$, then sintering under the same conditions. On measurement of the static withstand voltage of these contacts by the test method described above, a relative value of 0.8–1.2 was obtained, with a considerable range of variations (comparative example B7).

Contacts of composition: 30Mo—20Ti—Ag were obtained by molding powder obtained by mixing Mo powder of mean grain size 10 $\mu$m with Ti powder of mean grain size 50 $\mu$m under a molding pressure of 2 Ton/cm$^2$, followed by sintering in a vacuum atmosphere of the order of $10^{-3}$ Pa under the conditions 1173 K×1 Hr., then infiltrating Ag under vacuum atmosphere of the order of $10^{-3}$ Pa under the conditions 1300 K×0.5 Hr., and diffusion of Mo and Ti in Ag. When the static withstand voltage of these contacts was measured by the test method described above, a value of 1.0–1.2 in terms of relative values with respect to comparative example B7 was obtained, with little range of variations and improvement in the withstand voltage characteristic on the whole. The current interrupting characteristic also showed a value of 1.1 times that of comparative example B7 (example B7).

COMPARATIVE EXAMPLE B8, EXAMPLE B8

Contacts of composition: 20Mo—20W—10Y—Ag were obtained by molding with a molding pressure of 8 Ton/cm$^2$ powder obtained by mixing Mo powder of mean grain size 10 μm, W powder of mean grain size 7 μm, Y powder of mean grain size 100 μm and Ag powder of mean grain size 30 μm, followed by sintering under the vacuum atmosphere of the order of $10^{-3}$ Pa under the conditions 1173 K×1 Hr., followed by further molding under a molding pressure of 8 Ton/cm$^2$, then sintering under the same conditions. On measurement of the static withstand voltage of these contacts by the test method described above, a relative value of 0.8–1.2 was obtained, with a considerable range of variations (comparative example B8).

Contacts of composition: 20Mo—20W—10Y—Ag were obtained by molding powder obtained by mixing Mo powder of mean grain size 10 μm, W powder of mean grain size 7 μm and Y powder of mean grain size 100 μm, under a molding pressure of 2 Ton/cm$^2$, followed by sintering in a vacuum atmosphere of the order of $10^{-3}$ Pa under the conditions 1173 K×1 Hr., then infiltrating Ag under vacuum atmosphere of the order of $10^{-3}$ Pa under the conditions 1300 K×0.5 Hr., and diffusion of Mo, W and in Y Ag. When the static withstand voltage of these contacts was measured by the test method described above, a value of 1.0–1.2 in terms of relative values with respect to comparative example B8 was obtained, with little range of variations and improvement in the withstand voltage characteristic on the whole. The current interrupting characteristic also showed a value of 1.1 times that of comparative example B8 (example B8).

COMPARATIVE EXAMPLE B9, EXAMPLE B9

Contacts of composition: 20Co—20Ni—10Ti—Ag were obtained by molding with a molding pressure of 8 Ton/cm$^2$ powder obtained by mixing Co powder of mean grain size 10 μm, Ni powder of mean grain size 10 μm, Ti powder of mean grain size 50 μm and Ag powder of mean grain size 30 μm, followed by sintering under vacuum atmosphere of the order of $10^{-3}$ Pa under the conditions 1173 K×1 Hr., followed by further molding under a molding pressure of 8 Ton/cm$^2$, then sintering under the same conditions. On measurement of the static withstand voltage of these contacts by the test method described above, a relative value of 0.8–1.2 was obtained, with a considerable scattering of variations (comparative example B9).

Contacts of composition: 20Co—20Ni—10Ti—Ag were obtained by molding powder obtained by mixing Co powder of mean grain size 10 μm, Ni powder of mean grain size 10 μm and Ti powder of mean grain size 50 μm, under a molding pressure of 2 Ton/cm$^2$, followed by sintering in a vacuum atmosphere of the order of $10^{-3}$ Pa under the conditions 1173 K×1 Hr., then infiltrating Ag under vacuum atmosphere of the order of $10^{-3}$ Pa under the conditions 1300 K×0.5 Hr., and diffusion of Co, Ni and Ti in Ag. When the static withstand voltage of these contacts was measured by the test method described above, a value of 1.0–1.2 in terms of relative values with respect to comparative example B9 was obtained, with little range of variations and improvement in the breakdown voltage characteristic on the whole. The current interrupting characteristic also showed a value of 1.1 times that of comparative example B9 (example B9).

COMPARATIVE EXAMPLE B10, EXAMPLE B10

Contacts of composition: 30Cr—20 V—10Ag—Cu were obtained by molding with a molding pressure of 8 Ton/cm$^2$ powder obtained by mixing Cr powder of mean grain size 100 μm, V powder of mean grain size 100 μm, Ag powder of mean grain size 30 μm and Cu powder of mean grain size 45 μm, followed by sintering under vacuum atmosphere of the order of $10^{-3}$ Pa under the conditions 1000 K×1 Hr., followed by further molding under a molding pressure of 8 Ton/cm$^2$, then sintering under the same conditions. On measurement of the static withstand voltage of these contacts by the test method described above, a relative value of 0.8–1.2 was obtained, with a considerable range of variations (comparative example B10).

Contacts of composition: 30Cr—20 V—10Ag—Cu were obtained by molding powder obtained by mixing Cr powder of mean grain size 100 μm with V powder of mean grain size 100 μm under a molding pressure of 2 Ton/cm$^2$, followed by sintering in a vacuum atmosphere of the order of $10^{-3}$ Pa under the conditions 1173 K×1 Hr., then infiltrating 20 Ag—Cu under vacuum atmosphere of the order of $10^{-3}$ Pa under the conditions 1300 K×0.5 Hr., and diffusion of Cr and V in the Cu—Ag. When the static withstand voltage of these contacts was measured by the test method described above, a value of 1.0–1.2 in terms of relative values with respect to comparative example B10 was obtained, with little range of variations and improvement in the withstand voltage characteristic on the whole. The current interrupting characteristic also showed a value of 1.1 times that of comparative example B10 (example B10).

COMPARATIVE EXAMPLE B11, EXAMPLE B11

Contacts of composition: 30Cr—20W—0.5Bi—Cu were obtained by molding with a molding pressure of 8 Ton/cm$^2$ powder obtained by mixing Cr powder of mean grain size 100 μm, W powder of mean grain size 7 μm, Bi powder of mean grain size 100 μm and Cu powder of mean grain size 45 μm, followed by sintering under vacuum atmosphere of the order of $10^{-3}$ Pa under the conditions 1273 K×1 Hr., followed by further molding under a molding pressure of 8 Ton/cm$^2$, then sintering under the same conditions. On measurement of the static withstand voltage of these contacts by the test method described above, a relative value of 0.8–1.2 was obtained, with a considerable range of variations (comparative example B11).

Contacts of composition: 30Cr—20W—0.5Bi—Cu were obtained by molding powder obtained by mixing Cr powder of mean grain size 100 μm with W powder of mean grain size 7 μm under a molding pressure of 2 Ton/cm$^2$, followed by sintering in a vacuum atmosphere of the order of $10^{-3}$ Pa under the conditions 1300 K×1 Hr., then infiltrating 1Bi—Cu under vacuum atmosphere of the order of $10^{-3}$ Pa under the conditions 1300 K×0.5 Hr., and diffusion of Cr and W in Cu. When the static withstand voltage of these contacts was measured by the test method described above, a value of 1.0–1.2 in terms of relative values with respect to comparative example B11 was obtained, with little range of variations and improvement in the withstand voltage characteristic on the whole. The current interrupting characteristic also showed a value of 1.2 times that of comparative example B11 (example B11).

COMPARATIVE EXAMPLE B12, EXAMPLE B12

Contacts of composition: 30Cr—20W—0.5Bi—0.3Te—0.2Sb—Cu were obtained by molding with a molding pressure of 8 Ton/cm$^2$ powder obtained by mixing Cr powder of mean grain size 100 $\mu$m, W powder of mean grain size 7 $\mu$m, Bi powder of mean grain size 100 $\mu$m, Te powder of mean grain size 100 $\mu$m, Sb powder of mean grain size 100 $\mu$m and Cu powder of mean grain size 45 $\mu$m, followed by sintering under vacuum atmosphere of the order of $10^{-3}$ Pa under the conditions 1273 K×1 Hr., followed by further molding under a molding pressure of 8 Ton/cm$^2$, then sintering under the same conditions. On measurement of the static withstand voltage of these contacts by the test method described above, a relative value of 0.8–1.2 was obtained, with a considerable range of variations (comparative example B12).

Contacts of composition: 30Cr—20W—0.5Bi—0.3Te—0.2Sb—Cu were obtained by molding powder obtained by mixing Cr powder of mean grain size 100 $\mu$m with W powder of mean grain size 7 $\mu$m under a molding pressure of 2 Ton/cm$^2$, followed by sintering in a vacuum atmosphere of the order of $10^{-3}$ Pa under the conditions 1300 K×1 Hr., then infiltrating 1.0Bi—0.6Te—0.4Sb—Cu under vacuum atmosphere of the order of $10^{-3}$ Pa under the conditions 1300 K×0.5 Hr., and diffusion of Cr and W in Cu. When the static withstand voltage of these contacts was measured by the test method described above, a value of 1.0–1.2 in terms of relative values with respect to comparative example B12 was obtained, with little range of variations and improvement in the withstand voltage characteristic on the whole. The current interrupting characteristic also showed a value of 1.2 times that of comparative example B12. In this example, Bi Te and Sb function as welding prevention constituents (example B12).

COMPARATIVE EXAMPLE B13, EXAMPLES B13–B16, COMPARATIVE EXAMPLE B14

Contacts having a composition: 10Cr—5W—Cu as shown in Table B2, were obtained by molding powder obtained by mixing Cr powder of mean grain size 100 $\mu$m, W powder of mean grain size 7 $\mu$m and Cu powder of mean grain size 45 $\mu$m, at a molding pressure of 8 Ton/cm$^2$, followed by sintering in a vacuum atmosphere of the order of $10^{-3}$ Pa under the conditions 1400 K×0.5 Hr., performing diffusion of Cr and W in the Cu liquid phase. When the static withstand voltage of these contacts was measured by the test method described above, relative values of 0.9–1.1 were obtained (comparative example B13).

Contacts having a composition: 15Cr—10W—Cu were obtained by molding a powder obtained by mixing Cr powder of mean grain size 100 $\mu$m, W powder of mean grain size 7 $\mu$m and Cu powder of mean grain size 45 $\mu$m, at a molding pressure of 8 Ton/cm$^2$, followed by sintering in a vacuum atmosphere of the order of $10^{-3}$ Pa under the conditions 1400 K×0.5 Hr., performing diffusion of Cr and W in the Cu liquid phase. When the static withstand voltage of these contacts was measured by the test method described above, a relative value of 1.0–1.2 with respect to comparative example 13 was obtained. The current interrupting characteristic also showed a value of 1.3 times that of comparative example B13 i.e. good performance was shown (example B13).

Powder obtained by mixing Cr powder of mean grain size 100 $\mu$m with W powder of mean grain size 7 $\mu$m was filled in a carbon crucible and sintered in a vacuum atmosphere of the order of $10^{-3}$ Pa under the conditions 1400 K×0.5 Hr. to obtain a sintered body. Contacts having a composition: 30Cr—10W—Cu were then obtained by infiltrating Cu into the sintered body under the conditions 1400 K×1 Hr. under vacuum atmosphere of the order of $10^{-3}$ Pa, and conducting diffusion of Cr and W in the Cu liquid phase. When the static withstand voltage of these contacts was measured by the test method described above, a relative value of 1.0–1.2 with respect to comparative example B13 was obtained. The current interrupting characteristic also showed a value of 1.2 times that of comparative example B13 i.e. good performance was shown (example B14).

Powder obtained by mixing Cr powder of mean grain size 100 $\mu$m with W powder of mean grain size 7 $\mu$m was molded under a molding pressure of 3.5 Ton/cm$^2$ and sintered in a vacuum atmosphere of the order of $10^{-3}$ Pa under the conditions 1400 K×1 Hr. to obtain a sintered body. Contacts having a composition: 40Cr—20W—Cu were then obtained by infiltrating Cu into the sintered body under the conditions 1400 K×0.5 Hr., under vacuum atmosphere of the order of $10^{-3}$ Pa, and conducting diffusion of Cr and W in the Cu liquid phase. When the static withstand voltage of these contacts was measured by the test method described above, a relative value of 1.0–1.2 with respect to comparative example B13 was obtained. The current interrupting characteristic also showed a value of 1.2 times that of comparative example B13 i.e. good performance was shown (example B15).

Powder obtained by mixing Cr powder of mean grain size 100 $\mu$m with W powder of mean grain size 7 $\mu$m was molded under a molding pressure of 3.5 Ton/cm$^2$ and sintered in a vacuum atmosphere of the order of $10^{-3}$ Pa under the conditions 1400 K×1 Hr. to obtain a sintered body. Contacts having a composition: 55Cr—30W—Cu were then obtained by infiltrating Cu into the sintered body under the conditions 1400 K×0.5 Hr. under vacuum atmosphere of the order of $10^{-3}$ Pa, and conducting diffusion of Cr and W in the Cu liquid phase. When the static withstand voltage of these contacts was measured by the test method described above, a relative value of 1.0–1.2 with respect to comparative example B13 was obtained. The current interruption characteristic also showed a value of 1.2 times that of comparative example B13 i.e. good performance was shown (example B16).

Powder obtained by mixing Cr powder of mean grain size 100 $\mu$m with W powder of mean grain size 7 $\mu$m was molded under a molding pressure of 8 Ton/cm$^2$ and sintered in a vacuum atmosphere of the order $10^{-3}$ Pa under the conditions 1400 K×1 Hr. to obtain a sintered body. Contacts having composition: 65Cr—25W—Cu were then obtained by infiltrating Cu into the sintered body under the conditions 1400 K×0.5 Hr. under vacuum atmosphere of the order of $10^{-3}$ Pa, and conducting diffusion of Cr and W in the Cu liquid phase. When the static withstand voltage of these contacts was measured by the test method described above, a relative value of 1.0–1.2 with respect to comparative example B13 was obtained. However, when a current interrupting test was carried out, severe welding took place (comparative example B14).

As described above, a withstand voltage characteristic can be obtained which is more stable than that of contact material in which there is no diffusion and a better current interrupting performance can also be obtained, by mutual diffusion of a plurality of arc-proof constituents through the solution of a conductive constituent. Evidently the combinations of the arc proof constituents are not restricted to those described in the examples.

As described above, with another embodiment of this invention, there can be provided a contact material for a vacuum valve and a method for manufacturing the same wherein a mixture of arc-proof constituents of at least two or more kinds is sintered, thus diffusing the mixture constituents in the solution of the conductive constitutent, thereby enabling a contact material to be obtained which has excellent withstand voltage characteristic and current interrupting performance.

As described above, according to this invention there can be provided a contact material for a vacuum valve and a method for manufacturing the same, wherein the frequency of the occurrence of restriking can be reduced.

There can be further provided a contact material for a vacuum valve and a method for manufacturing the same, which has a stable high withstand voltage characteristic and an excellent current interruption performance.

Obviously, numerous modifications and variations of the present invention are possible in light of the above teachings. It is therefore to be understood that within the scope of the appended claims, the invention may be practiced otherwise than as specifically described herein.

What is claimed is:

1. A method for manufacturing a contact material for a vacuum valve, comprising the steps of:

preparing a composite body, comprising, a conductive constituent comprising at least copper, arc-proof constituent comprising at least chromium, and an auxiliary constituent comprising at least one selected from the group consisting of tungsten, molybdenum, tantalum and niobium; and quench solidificating said composite body to obtain said contact material.

2. The method according to claim 1, wherein:

in said preparing step, a consumable electrode is prepared as said composite body; and in said quench solidificating step, said consumable electrode is used to obtain said contact material by a consumable arc melting method.

3. The method according to claim 1, wherein:

in said quench solidificating step, said composite body is used to obtain said contact material by an electroslag method.

4. The method according to claim 1, wherein in said quench solidifying step, said composite body is used to obtain said contact material by an electroslag method or a consumable arc melting method.

5. The method according to claim 1, wherein said auxiliary constituent comprises tungsten.

6. The method according to claim 1, wherein said auxiliary constituent comprises molybdenum.

7. The method according to claim 1, wherein said auxiliary constituent comprises tantalum.

8. The method according to claim 1, wherein said auxiliary constituent comprises niobium.

9. The method according to claim 2, wherein said consumable electrode is prepared by a sheet material lamination method.

10. The method according to claim 2, wherein said consumable electrode is prepared by a powder metallurgy method.

11. The method according to claim 1, wherein said composite body consists essentially of said copper, said chromium, and said at least one selected from the group consisting of tungsten, molybdenum, tantalum and niobium.

12. The method according to claim 1, wherein said composite body consists of said copper, said chromium and said at least one member selected from the group consisting of tungsten, molybdenum, tantalum and niobium.

13. The method according to claim 1, wherein said chromium is present in an amount of 20–50 vol. %.

14. The method according to claim 1, wherein said auxiliary constituent is present in an amount of 1–10 vol. %.

15. The method according to claim 1, wherein said chromium is present in an amount of 20–50 vol. %, and said auxiliary constituent is present in an amount of 1–10 vol. %.

16. A method for manufacturing a contact material for a vacuum valve, comprising:

quench solidificating a composite body to obtain said contact material;

wherein said composite body comprises copper, chromium, and at least one member selected from the group consisting of tungsten, molybdenum, tantalum and niobium.

17. The method according to claim 16, wherein said quench solidificating is a consumable arc melting method.

18. The method according to claim 16, wherein said quench solidificating is an electroslag method.

19. The method according to claim 16, wherein said composite body consists essentially of said copper, said chromium, and said at least one member selected from the group consisting of tungsten, molybdenum, tantalum and niobium.

20. The method according to claim 16, wherein said chromium is present in an amount of 20–50 vol. %, and said at least one member is present in an amount of 1–10 vol. %.

* * * * *